US005339234A

United States Patent [19]

Russello et al.

[11] Patent Number: 5,339,234

[45] Date of Patent: Aug. 16, 1994

[54] LIGHTING FIXTURE WITH RATCHETED SWIVEL SOCKET SLIDING WITHIN SLOT

[75] Inventors: Thomas Russello, Howell; Richard Sangiamo, Linden, both of N.J.

[73] Assignee: The Genlyte Group Incorporated, Secaucus, N.J.

[21] Appl. No.: 52,483

[22] Filed: Apr. 23, 1993

[51] Int. Cl.[5] ..... F21S 1/02

[52] U.S. Cl. ..... 362/419; 362/269; 362/287; 403/353

[58] Field of Search ..... 362/199, 269, 283, 285, 362/287, 362, 371, 418, 419, 421; 403/61, 353, 355, 354, 350

[56] References Cited

U.S. PATENT DOCUMENTS

| | | | |
|---|---|---|---|
| 1,612,806 | 1/1927 | Gehersky | 362/421 |
| 1,792,902 | 2/1931 | Haines | 362/199 |
| 4,447,863 | 5/1984 | Fenne | 362/287 |
| 4,654,764 | 3/1987 | Hsiao | 362/287 |
| 4,749,311 | 6/1988 | Watermann et al. | 403/353 |

FOREIGN PATENT DOCUMENTS

| | | | |
|---|---|---|---|
| 4-267004 | 9/1992 | Japan | 362/418 |
| 354697 | 2/1930 | United Kingdom | 362/418 |

*Primary Examiner*—Ira S. Lazarus
*Assistant Examiner*—Alan B. Cariaso
*Attorney, Agent, or Firm*—Kane, Dalsimer, Sullivan, Kurucz, Levy, Eisele and Richard

[57] ABSTRACT

The apparatus is a light fixture with a base unit and a socket assembly unit. The socket assembly unit includes a male element which includes laterally opposed parallel notches and a peripheral ring with radial teeth surrounding a least a portion thereof. The male element is inserted into a slot in the base unit and a spring steel clip is engaged between the laterally opposed parallel notches thereby urging a V-shaped protrusion against the radial teeth of the ring and providing a rotating ratchet function for the socket assembly unit.

5 Claims, 3 Drawing Sheets

LIGHTING FIXTURE WITH RATCHETED SWIVEL SOCKET SLIDING WITHIN SLOT

BACKGROUND OF THE INVENTION

1. Field of the Invention

This invention pertains to a light fixture with a ratcheted swivelling socket which slides within an arcuate, generally vertical, slot.

2. Description of the Prior Art

In the prior art, light fixtures are known which have a simple frictionally engaged, variably adjustable, swivelled socket with respect to the fixed base of the fixture. However, these designs are deficient in that it is difficult to keep the socket fixed in a single position over a long period of time unless the fit or engagement at the swivel point is made so tight that initial swivelling is difficult.

Additionally, these swivelled sockets which rely entirely on a friction fit have typically provided for simple rotation with one or two degrees of freedom with respect to the base without allowing for more complex freedom of movement.

Moreover, recent advances in high-illumination, low wattage, Edison socket-type bulbs with compact internal fluorescent tubes in the place of incandescent wire filaments have increased the need for an outdoor fixture without the deficiencies identified above.

SUMMARY AND OBJECTS OF THE INVENTION

It is therefore an object of this invention to provide a lighting fixture with a swivelled socket with a ratcheted attachment to the base of the fixture.

It is therefore a further object of this invention to provide a lighting fixture with a socket which swivels with respect to the base in a more complex way than simple rotation with one or two degrees of freedom.

It is therefore a still further object of this invention to provide a light fixture with a swivel-mounted Edison socket adapted to bulbs with internal fluorescent tubes, particularly for outdoor use.

It is therefore a final object of this invention to provide a light fixture which is easily and inexpensively manufactured.

These and other objects are attained by providing a light fixture with a socket with a male element with a radially toothed ring peripherally outward from a least a portion thereof and radially opposed parallel notches on lateral sides thereof. The male element fits within an arcuate, generally vertical slot within the base of the fixture. The slot includes an elongated portion with a reduced diameter which corresponds to the distance between the radially opposed parallel notches of the male portion. The slot further includes an end of increased diameter which corresponds to the outer diameter of the male element. A spring steel fastener with a V-shaped portion engages the notches of the male element of the socket after the male element has passed through the slot. The V-shaped portion of the spring steel fastener engages the radial teeth of the ring thereby providing a ratchet-type feature. Additionally, the male element has the freedom to slide to various positions within the arcuate slot, thereby providing further adjustability to the orientation of the bulb.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
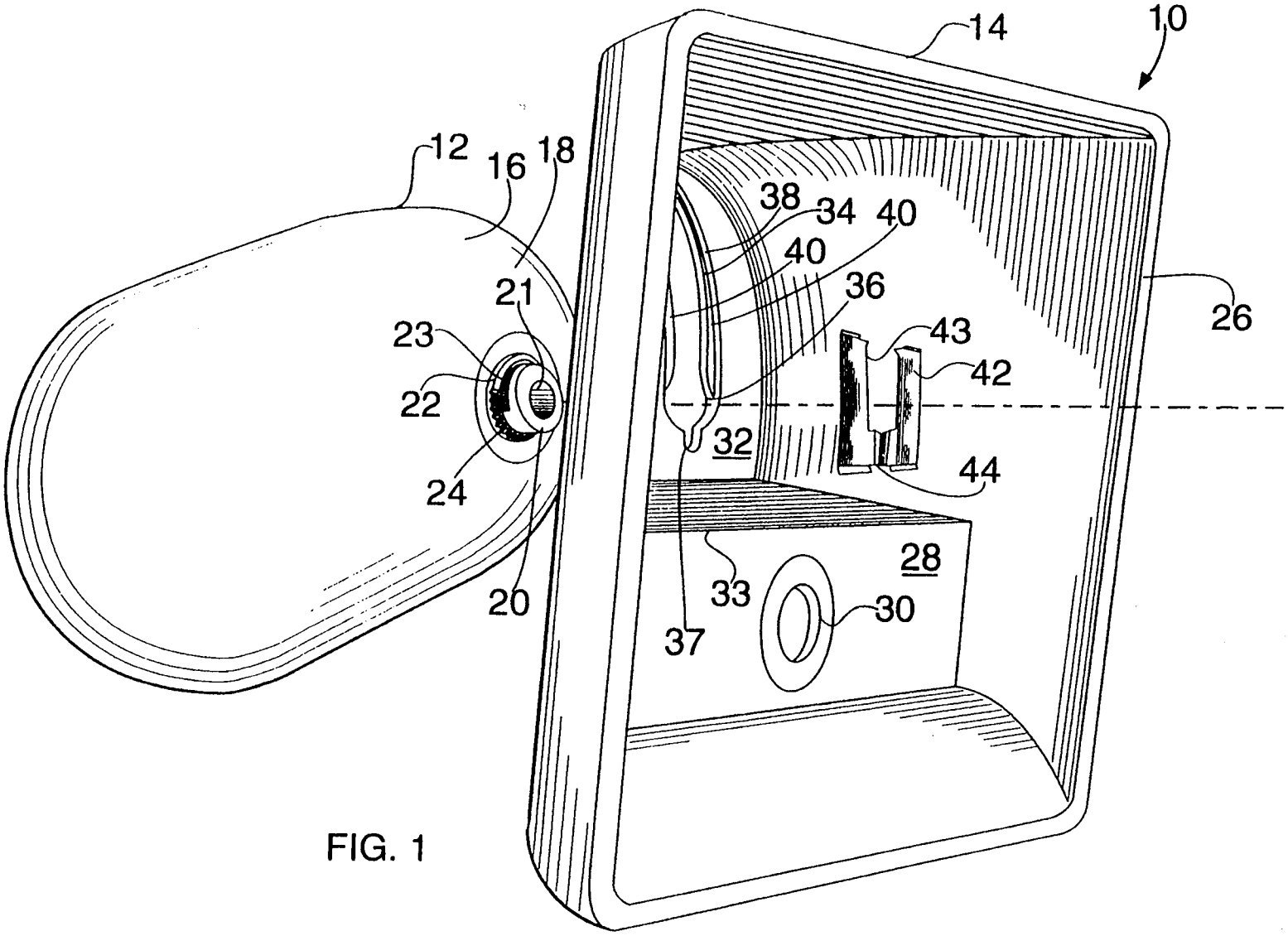
FIG. 1 shows an exploded rear perspective view of the invention.

Referring now to the drawings in detail wherein like numerals refer to like elements throughout the several views, one sees that FIG. 1 discloses an exploded view of fixture 10.

Figure 2:
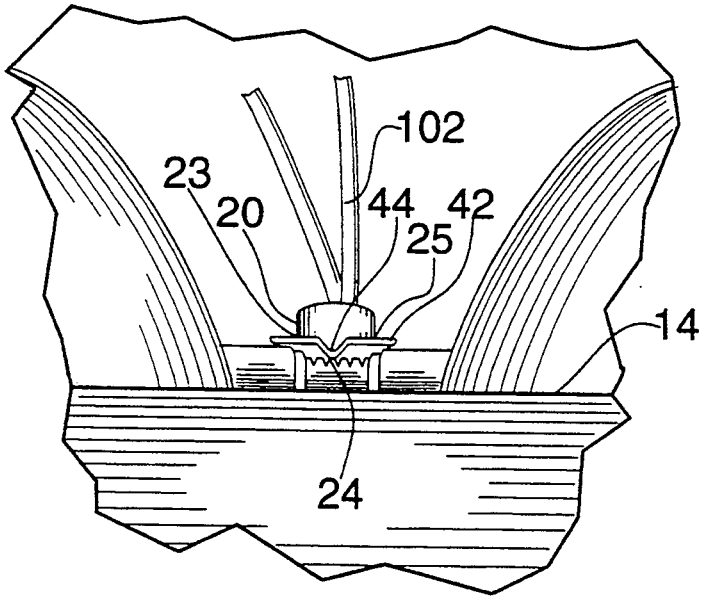
FIG. 2 shows a fragmentary view of the engagement of the spring steel fastener to the male element of the socket and the slot of the base of the fixture.
Figure 3:
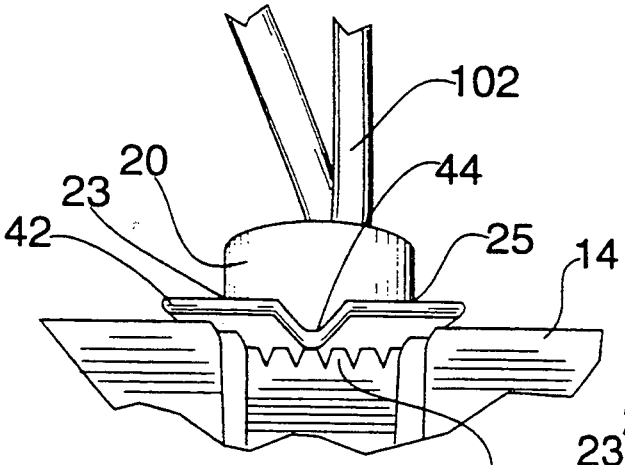
FIG. 3 shows a close-up view of the spring steel fastener wherein the V-portion is between the furrows of the radially toothed ring.
Figure 4:
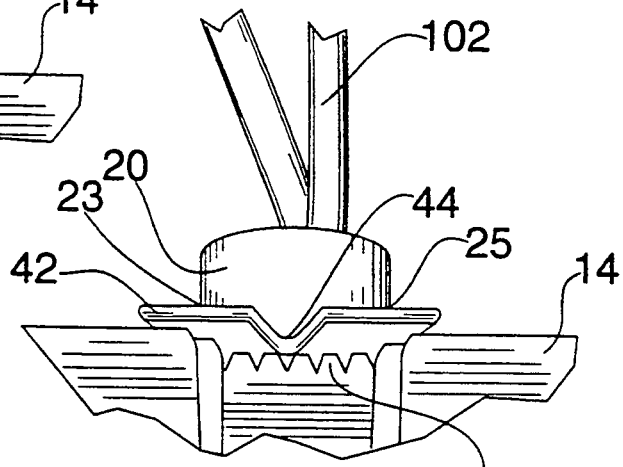
FIG. 4 shows a close-up view of the spring steel fastener wherein the V-portion is engaged within a furrow of the radially toothed ring.
Figure 5:
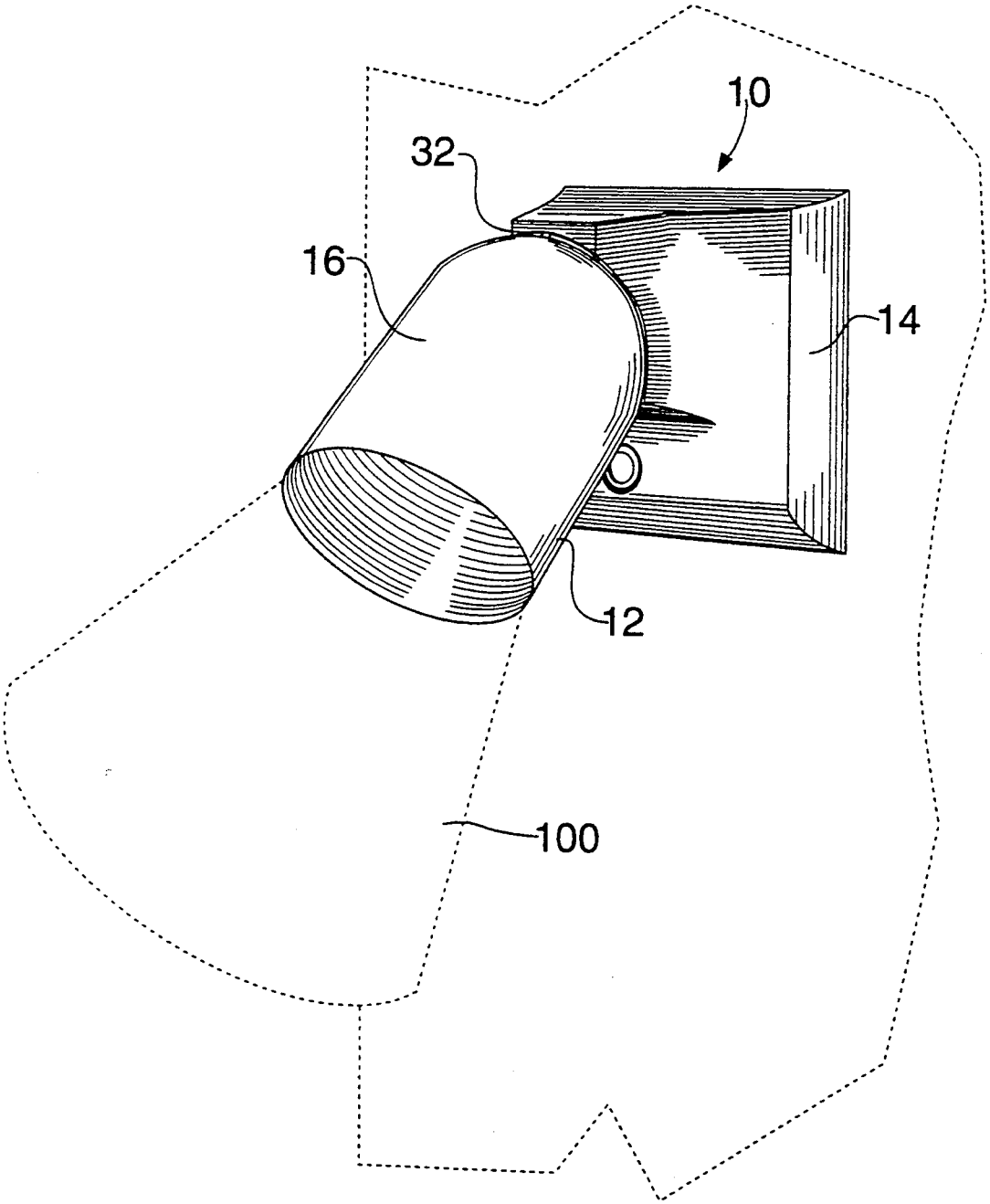
FIG. 5 is a front perspective view of the light fixture, showing the bulb in phantom.

Fixture 10 includes a socket assembly 12 and base 14. Socket assembly 12 includes shroud 16 which includes therein a conventional Edison socket (not shown) for engaging bulb 100 (see FIG. 5 for the relationship of bulb 100 to fixture 10) which is preferably a low-wattage, high illumination bulb with internal fluorescent tubes. Proximal end 18 of shroud 16 is rounded, preferably hemispheric, and includes hollow cylindrical male element 20 which is offset from the longitudinal axis of shroud 16. Concentric aperture 21 within male element 20 provides a path for wires 102 (see FIGS. 2–4) to pass from socket assembly 12 through the base 14 and to a conventional source of external electrical power.

Male element 20 includes ring 22 around the periphery thereof proximate to shroud 16. Ring 22 includes a radially toothed portion 24. Additionally, male element 20 includes opposed parallel notches 23, 25 on lateral sides thereof.

Base 14 includes edge 26 which forms a planar portion for engagement to the installation surface, preferably a wall. Segment 28 of base 14 is outwardly adjacent, but parallel, to the plane defined by edge 26. Segment 28 includes aperture 30 which is used to secure base 14 to a wiring box (not shown) via a nipple and cap nut (not shown) or similar apparatus.

Arcuate surface 32 extends upwardly and outwardly from upper edge 33 of segment 28. Arcuate surface 32 is shaped to be complementary to proximal end 18, to engage the hemispherical portion of proximal end 18 of shroud 16, and to allow proximal end 18 to slide upwardly or downwardly along arcuate surface 32 thereby allowing for variation in the azimuthal orientation of socket assembly 12 and bulb 100 therein. Arcuate surface 32 further includes vertical slot 34 (vertical, yet following the contours of arcuate surface 32) which includes enlarged circular portion 36 at a lower portion thereof and elongated portion 38 of reduced diameter. Enlarged circular portion 36 includes nipple slot portion 37 at a lower end thereof.

Elongated portion 38 achieves its reduced diameter by including indented inwardly extending wall segments 40 on both lateral sides thereof. The diameter of enlarged circular portion 36 is substantially equal to that of male element 20 thereby allowing male element 20 to be inserted through enlarged circular portion 36. The width of elongated portion 38 (as measured between the indented inwardly extending wall segments 40) is substantially equal to the distance between the opposed parallel notches 23, 25 of male element 20, thereby allowing male element 20 to slide captively within elongated portion 38.

Spring steel clip 42 includes longitudinal slot 43 of a width equal to the distance between the opposed parallel notches 23, 25, and a V-shaped tooth 44.

To install socket assembly 12 to base 14, male element 20 of socket assembly 12 is inserted through enlarged circular portion 36 of vertical slot 34 of base 14. In order to provide resilience between socket assembly 12 and base 14 for improving the ratchet function therebetween (to be described), a thin sheet of foam rubber (not shown) may be added between socket assembly 12 and base 14. Preferably, the thin sheet of foam rubber is glued to arcuate surface 32 immediately adjacent to both lateral sides of vertical slot 34.

After male element has been inserted through enlarged circular portion 36 of vertical slot 34, slot 43 of spring steel clip 42 is engaged through opposed parallel notches 23, 25 (see FIGS. 2–4) so that V-shaped tooth 44 is initially engaged through nipple slot portion 37 and engaged against the teeth of radially toothed portion 24 thereby providing a ratchet function between socket assembly 12 and base 14 allowing socket assembly to rotate by discrete intervals (the rotational angle of that between successive teeth in the radially toothed portion 24) about an axis defined by the longitudinal axis of male element 20 in order to change the orientation of the direction of light emanating from bulb 100 of socket assembly 12. As previously described, the sheet of foam rubber (not shown) between the socket assembly 12 and base 14 provides a resiliency therebetween thereby enhancing the ratchet function.

Male element 20, supported by the spring steel clip 42, can slide within vertical slot 34 of arcuate surface 32 with opposed parallel notches 23, 25 riding on indented inwardly extending wall segments 40 further altering the azimuthal orientation of the direction of light emanating from bulb 100 of socket assembly 12.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A lighting fixture comprising:

a base means including a concave-shaped arcuate portion;

a socket assembly means, including means for engaging a bulb, means for receiving electrical power, and a shroud including a proximal portion with a convex-shaped arcuate portion complementary to said concave-shaped arcuate portion;

means for engaging said base means to said socket assembly means, including means for ratchedly rotating said socket assembly, and means for adjusting an azimuthal orientation of said socket assembly by sliding said convex-shaped arcuate portion against said concave-shaped arcuate portion;

said means for engaging said base means to said socket assembly means including a male element extending from said convex-shaped arcuate portion of said socket assembly means engaged by a slot in said concave-shaped arcuate portion of said base means;

said male element having an outer diameter and laterally opposed parallel notches separated by a distance less than said outer diameter; and said slot including a first portion of a width substantially equal to said outer diameter of said male element, and a second portion of a width substantially equal to said distance separating said laterally opposed parallel notches.

2. The light fixture of claim 1 wherein said first portion is substantially circular and said second portion is elongated.

3. The light fixture of claim 2 wherein said first portion is differentiated from said second portion by indented inwardly extending wall segments formed on said second portion thereby reducing a width thereof.

4. The light fixture of claim 3 wherein said means for ratchedly rotating said socket assembly includes a ring around at least a portion of a periphery of said male element, said ring including radial teeth around at least a portion thereof.

5. The light fixture of claim 4 wherein said means for engaging said base means to said socket assembly means includes a spring steel clip means, said spring steel clip means comprising a slot of a width substantially equal to said distance between said laterally opposed parallel notches and further comprising a V-shaped protruding section, wherein said slot of said spring steel clip means engages said laterally opposed parallel notches thereby engaging said V-shaped protruding section against said radial teeth of said ring.

* * * * *